US009044121B2

(12) United States Patent
Phillips

(10) Patent No.: US 9,044,121 B2
(45) Date of Patent: Jun. 2, 2015

(54) CHARACTER-SHAPED POROUS MITT FOR HOUSING AND DISPENSING SOAP

(71) Applicant: PHILLIPS ENTERTAINMENT GROUP LLC, Los Angeles, CA (US)

(72) Inventor: E. Ray Phillips, Alhambra, CA (US)

(73) Assignee: Phillips Entertainment Group, LLC, Alhambra, CA (US)

( * ) Notice: Subject to any disclaimer, the term of this patent is extended or adjusted under 35 U.S.C. 154(b) by 0 days.

(21) Appl. No.: 14/013,776

(22) Filed: Aug. 29, 2013

(65) Prior Publication Data

US 2014/0059794 A1 Mar. 6, 2014

Related U.S. Application Data

(60) Provisional application No. 61/695,240, filed on Aug. 30, 2012.

(51) Int. Cl.
*A47K 7/03* (2006.01)
*A47K 7/02* (2006.01)

(52) U.S. Cl.
CPC .... *A47K 7/02* (2013.01); *A47K 7/03* (2013.01)

(58) Field of Classification Search
CPC ..... A47L 13/16; A47L 13/17; A47L 13/18; A47L 13/19; A47K 7/02; A47K 7/022; A47K 7/028; A47K 7/03
USPC ..... 401/196, 200, 201, 207, 6, 7, 8, 9
See application file for complete search history.

(56) References Cited

U.S. PATENT DOCUMENTS

| | | | | |
|---|---|---|---|---|
| 1,351,311 | A | 8/1920 | Virneburg | |
| 2,061,219 | A * | 11/1936 | Wright | 401/7 |
| 2,363,697 | A | 11/1944 | Schirmer | |
| 3,130,441 | A * | 4/1964 | Hahn | 401/201 |
| 3,143,755 | A * | 8/1964 | Rowley | 222/173 |
| 3,426,464 | A * | 2/1969 | Mezey | 401/201 |
| 4,154,542 | A | 5/1979 | Rasmason | |
| 4,457,640 | A * | 7/1984 | Anderson | 401/7 |
| 5,022,517 | A * | 6/1991 | Benitez | 206/77.1 |
| D405,925 | S | 2/1999 | Badillo | |
| 5,915,434 | A | 6/1999 | Juarez | |
| 5,983,435 | A | 11/1999 | Osborne | |
| 6,161,246 | A | 12/2000 | Trachtenberg | |
| D452,349 | S | 12/2001 | Badillo | |
| D452,590 | S | 12/2001 | Badillo | |
| D452,591 | S | 12/2001 | Badillo | |
| 7,014,381 | B1 * | 3/2006 | Graham | 401/201 |
| D532,158 | S | 11/2006 | Zall | |
| D532,554 | S | 11/2006 | Zall | |

(Continued)

*Primary Examiner* — David Walczak
(74) *Attorney, Agent, or Firm* — Rutan & Tucker LLP; John K. Fitzgerald

(57) ABSTRACT

A character-shaped porous mitt for housing and dispensing soap comprised of an outer body formed from terry cloth or similar material and a sponge-like material lining an interior cavity containing a soap pocket in which to hold bar or liquid soap that is fastened using a hook-and-loop fastener. An area at the mouth, the body or the rear of the mitt through which the bar of soap or the liquid soap can be received and housed until the soap mixes with water to produce a rich lather with which to cleanse a user's body. Finger pockets or loops are configured to receive the fingers of a user to allow the user to securely hold the mitt, even in the presence of rich lather. A rough-textured portion of the outer body provides added friction between the outer body and skin of a user to allow the user to scrub or exfoliate his or her skin.

18 Claims, 5 Drawing Sheets

(56) References Cited

U.S. PATENT DOCUMENTS

| | | | |
|---|---|---|---|
| D535,438 | S | 1/2007 | Zall |
| D535,439 | S | 1/2007 | Zall |
| D576,768 | S | 9/2008 | Schulte |
| D578,253 | S | 10/2008 | Schulte |
| D578,709 | S | 10/2008 | Schulte |

* cited by examiner

CHARACTER-SHAPED POROUS MITT FOR HOUSING AND DISPENSING SOAP

CROSS-REFERENCES TO RELATED APPLICATIONS

This application claims priority from U.S. Provisional Application No. 61/695,240, filed Aug. 30, 2012 incorporated by reference in its entirety.

BACKGROUND

The invention is directed to the field of bath and shower mitts, and more specifically, bath and shower mitts that are made of a natural or synthetic sponge, or a sponge-like material, and made into the shape of a fictional or non-fictional character that mainly appeals to children.

It has long been known that when soap and water interact, the combination produces a rich lather. Such rich lather is desirable to one who is taking a bath or a shower and desires to get maximally clean. A bath or shower mitt that allows one to easily insert or remove soap at more than one point of insertion, while keeping the soap in place and maximizing its interaction with water, has been missing from the market.

A variety of bath and shower mitts are currently on the market that provide for a pocket-like area on the surface of the mitt into which one may insert a bar of soap or liquid soap. Some of these mitts are shaped like animals or fictional characters, for example, but they fail to simplify the process of inserting and retaining soap and water inside the mitt to allow for maximum production of lather to cleanse one's body during a bath or shower, while at the same time being easy to grip during use and providing entertainment for children.

Additionally, the bath and shower mitts that are currently on the market do not allow for the soap to be inserted into the mitt in more than one manner or position within the mitt, which would allow one to determine the most advantageous position in which to hold the mitt based on his or her own preference while bathing. Further, it appears that the more functional the mitt as a cleansing implement, the less appealing it is to children, especially young children. There is a present need for bath and shower mitts that not only securely hold soap in place, but also appeal to children, and allow for the mitt to be securely held while it is in use.

What has been needed, and heretofore unavailable, is a bath and shower mitt into which a bar of soap or liquid soap can be inserted, such that the soap will stay in place during the cleansing process, rather than sliding off of the mitt. Such a mitt will also be appealing to children and have the soap enclosed in the top portion of the mitt, but will easily allow the immediate removal of the bar of soap or other soap source when desired. Further, the bath and shower mitt will retain water in such a way that maximizes the interaction between soap and water to produce a rich lather. The present invention satisfies these, and other needs.

SUMMARY OF THE INVENTION

In its most general aspect, the present invention provides for optimized interaction between soap and water through the retention of soap and water inside an interior cavity, which is lined with a sponge-like material and contains a soap pocket in which to securely hold soap. Further, the various aspects of the present invention lend themselves to being firmly gripped on both sides and to scrub or exfoliate a user's body, further enhancing the cleansing experience. Moreover, the outer body of the present invention may be shaped like a fictional or non-fictional character that appeals to children. Such a feature is advantageous in that it turns a utilitarian bath or shower mitt into a source of play and entertainment for children, providing a more satisfactory bathing experience not only for a child, but also for a parent tasked with giving the child a bath or shower. In another aspect, the outer body may be shaped as a non-character or icon, such as a sports logo, automobile, airplane, sport ball, sport equipment or the like.

In its various aspects, the present invention is a character-shaped porous cleansing mitt, comprising an outer body, a cavity disposed within an interior of the outer body, an opening in a portion of the outer body providing access to the cavity, and a finger pocket or loop configured to receive a user's fingers. The mitt comprises a natural or synthetic sponge, or sponge-like material, disposed within the cavity, with the sponge-like material having a soap pocket formed therein. The soap pocket is lined with a water-permeable material that is configured to receive soap and provides structural reinforcement to the sponge to maintain the soap within the soap pocket under use. The soap is allowed to have a close and consistent interaction with water, providing for the production of a rich lather. There is a rough texture on a side of the mitt, providing for added friction between the outer body of the mitt and skin of a user and allowing a user to scrub or exfoliate the skin to produce an overall satisfying cleansing experience.

In one aspect, a bar of soap or liquid soap may be inserted into the mouth or anterior portion of the character-shaped mitt and placed inside the interior cavity of the mitt inside a soap pocket made of nylon mesh or other water-permeable material.

In another aspect, the bar of soap is secured inside the soap pocket using, for example, a child-safe hook-and-loop fastener.

In yet another aspect, the present invention allows for the insertion of the bar of soap or liquid soap through the body of the character-shaped mitt and secured inside a nylon mesh, or other water-permeable material, soap pocket, which is then fastened using a hook-and-loop fastener.

In still another aspect, the present invention allows for the insertion of the bar of soap or liquid soap into the rear or tail portion of the character-shaped mitt and secured inside the soap pocket, which is then fastened using a hook-and-loop fastener.

In a further aspect, the present invention allows for openings on either side of the character-shaped mitt, which are configured to receive a user's fingers such that the user can maintain a solid grip of the mitt during use, even in soapy conditions. The character-shaped mitt may also have a rough texture on a side for providing added friction between the outer body of the mitt and skin of a user.

In yet another aspect, the present invention allows for the production of a rich lather due to its strong retention of water and secure positioning of soap inside the sponge-like interior cavity of the mitt, which maximizes the interaction between soap and water.

In still another aspect, the present invention includes a character-shaped porous cleansing mitt, comprising: an outer body; a cavity disposed within an interior of the outer body; an opening in a portion of the outer body providing access to the cavity; and a finger pocket or loop configured to receive a user's fingers. In one alternative aspect, the mitt includes a sponge-like material disposed within the cavity. In another aspect, the sponge-like material has a soap pocket formed therein. In still another aspect, the sponge-like material may have weep holes or other modifications that promote or improve the formation of lather. In still another aspect, the sponge-like material may be replaced with a non-sponge material such as a frog luffa or synthetic material that functions similarly to a sponge-like material.

In still another aspect, the soap pocket is lined with a water-permeable material, the water-permeable material providing structural reinforcement to the sponge to maintain the soap within the pocket under use. In another aspect, the water-permeable material is a nylon mesh.

In another aspect, the outer body is formed from a porous material. In an alternative aspect, the porous material is a terry cloth.

In yet another aspect, the cavity is configured to hold soap. In one alternative aspect, the soap is a solid bar. In another alternative aspect, the soap is a liquid.

In a further aspect, the material lining the pocket is attached to the mitt using a child-safe fastener. In one aspect, the fastener is a hook-and-loop fastener.

In still a further aspect, the opening is disposed within a mouth portion of the mitt. In an alternative aspect, the opening is disposed within a body portion of the mitt. In yet another alternative aspect, the opening is disposed within a rear portion of the mitt.

In yet another aspect, the finger pocket is configured to receive a user's fingers. In another aspect, the loop is configured to receive a user's fingers.

In still another aspect, the outer body has a rough-textured portion for providing added friction between the outer body and skin of a user.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
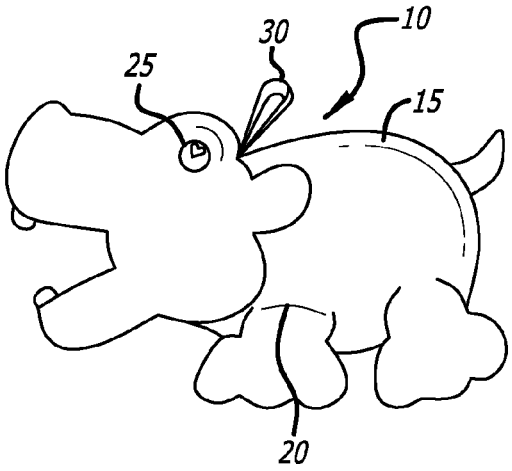
FIG. 1 is a side view of an embodiment of the present invention, which comprises a hippopotamus-shaped, mouth-fed bath mitt.

As shown in the drawings for purposes of illustration, the present invention is embodied in a character-shaped, synthetic sponge construct or porous mitt, that can be used to cleanse one's body. The ability to adequately cleanse one's body and have a positive experience while doing so has long been a challenge facing parents of young children. Not only are parents concerned with making sure that their children get as clean as possible while bathing or taking a shower, but they would also like for their children to have an enjoyable experience as well.

In general, the various embodiments of the present invention are directed to a bath or shower mitt, which outer body is formed into the shape of a fictional or non-fictional character that appeals to children. The character shape is generally defined by a central portion represent a torso or body, and various appendages representing arms, legs, fins or tails extending from the central portion. The various embodiments of the character-shaped mitt can be implemented by creating the character-shaped porous mitt from terry cloth or other porous material suitable to be used to cleanse one's body.

FIG. 1 illustrates one embodiment of the present invention. In this embodiment, a bath or shower mitt (hereinafter, "bath mitt") 10 has an exterior 15 formed in the shape of a hippopotamus. The exterior 15 may include various features, such as a finger pocket 20 that allows a finger of a user to be inserted in such a manner as to provide for a relatively secure handhold on the mitt. While only one finger pocket 20 is shown, it will be appreciated that another finger pocket can be disposed on the other side of the side of the mitt. Additionally, the exterior of the mitt may include one or more decorative features, such as the eye 25, and may also include a feature such as a tag or loop 30 which may be used to hang the mitt for drying or storage.

Figure 2:
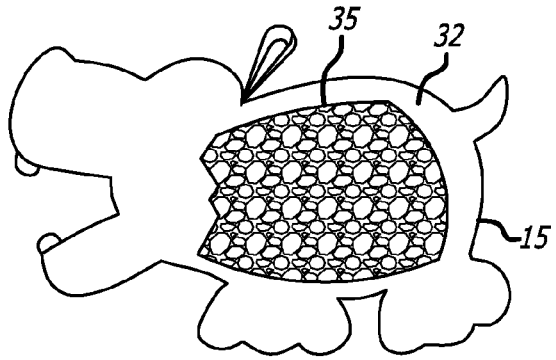
FIG. 2 is a side view, partially cut-away, of the embodiment of FIG. 1, illustrating a synthetic sponge material lining an interior cavity of the bath mitt of FIG. 1.

FIG. 2 is a cross sectional side view of the embodiment of FIG. 1 showing an interior cavity 32 formed inside the character-shaped porous mitt 10, the sides of which are lined with a natural or synthetic sponge 35, or sponge-like absorbent material to increase the interaction between soap and water. The sponge may be affixed to the sides of the interior cavity in various manners, such as by adhering the sponge to the fabric of the mitt using a suitable adhesive. Alternatively, the sponge may be affixed to the side of the interior cavity using other means, such as a hook and loop fastener, so that the sponge lining may be removed and replaced if necessary. The purpose of the sponge is to hold water and then to allow the water to mix with soap to produce a rich lather with which to cleanse one's body.

Figure 3:
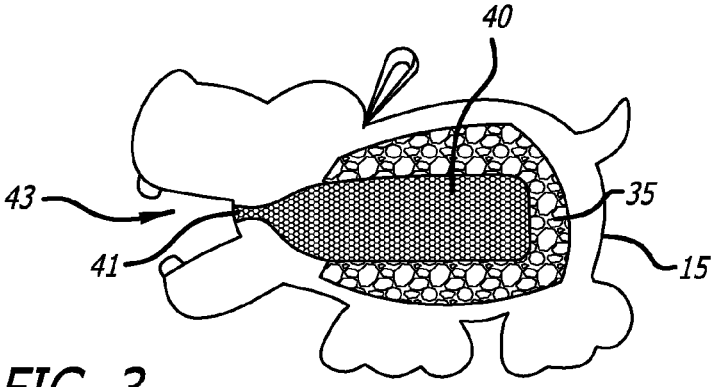
FIG. 3 is a side view, partially cut-away, of the embodiment of FIG. 1, illustrating a soap pocket formed within the synthetic sponge material lining the interior cavity of the bath mitt of FIG. 1.

As shown in FIG. 3, a soap pocket 40 created from a material such as, for example, nylon mesh, or similar water-permeable material, that is capable of holding a bar of soap or liquid soap is disposed within the interior cavity 32 inside of the sponge lining 35. As shown in this embodiment, soap pocket 40 has an extension 41 that provides access to the interior of the soap pocket 40. The extension 41 extends into the mouth area 43 of the character 10.

Figure 4:
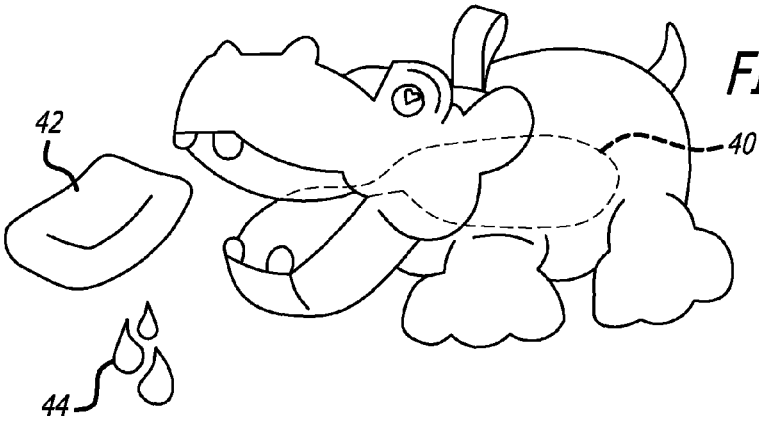
FIG. 4 is a side view of the embodiment of FIG. 1, illustrating the ability to insert a bar of soap or liquid soap through the mouth of the bath mitt and place the bar of soap inside a soap pocket of the bath mitt.
Figure 5:
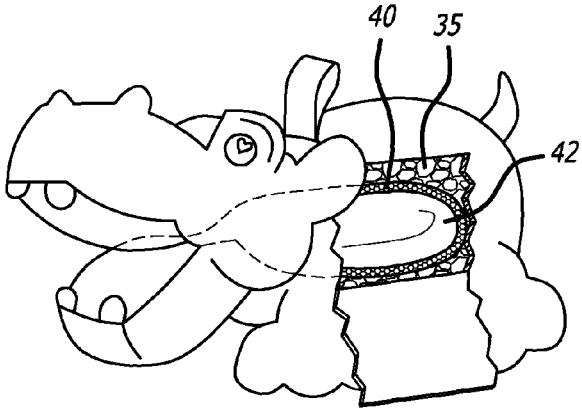
FIG. 5 is a side view, partially cut-away, of the embodiment of FIG. 4, illustrating the bar of soap inside the fastened soap pocket of the sponge-lined interior cavity of the bath mitt.

FIGS. 4-5 illustrate the insertion of a bar of soap 42 or liquid soap 44 into the soap pocket 40 disposed within the interior of the mitt. The bar of soap is inserted into the mouth of the character formed by the exterior of the mitt, through the extension of the soap pocket 41 (FIG. 3) until the soap is disposed within the interior of the soap pocket 40. When the mitt is soaked with water, the water is absorbed by the sponge layer 35. The mitt may be rubbed or otherwise manipulated to cause the soap, sponge, and water to interact such that a rich foam or lather is developed, which can then seep through the fabric of the mitt for application to a child's (or the user's) body.

Figure 6:
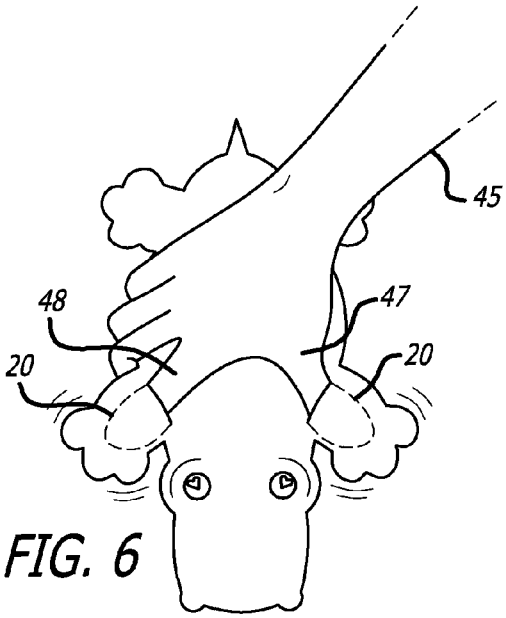
FIG. 6 is a top view of the embodiment of FIG. 1, illustrating the fingers of a user inside the finger pockets of the bath mitt.

FIG. 6 illustrates usage of the finger pockets 20 to hold the mitt. A user 45 may insert a finger in each of the finger pockets 20. Typically, the user will insert a thumb 47 of one hand in one pocket 20, and another finger, such as an index finger 48, in the other finger pocket 20. Not only do the finger pockets provide a firm grip on the mitt, but also allow the holder of the mitt to squeeze, shake, or otherwise manipulate the mitt to provide entertainment to a child being washed. Those skilled in the art will also understand that such manipulation may also be entertaining to the user of the mitt as well.

Figure 7:
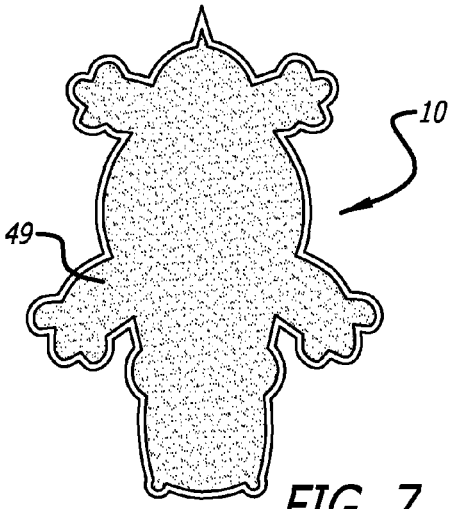
FIG. 7 is a bottom view of the embodiment of FIG. 6, illustrating a rough texture on the underside of the bath mitt.

FIG. 7 illustrates an embodiment of a character shaped bath mitt wherein the character shape is relatively flat on its bottom side, and that bottom side is covered with, or formed from, a material having a rough texture 49, providing for added friction between the mitt and the skin of a user, which is suitable for scrubbing or exfoliating the user's skin.

As shown with reference to the embodiment of FIG. 1, inserting the bar or liquid soap through the mouth of the character-shaped mitt provides for ease of use depending on the size and shape of the fictional or non-fictional character of the mitt, the size of one's hand or to maximize the surface area of the skin that is in contact with the rich lather created by the interaction between soap and water.

Figure 8:
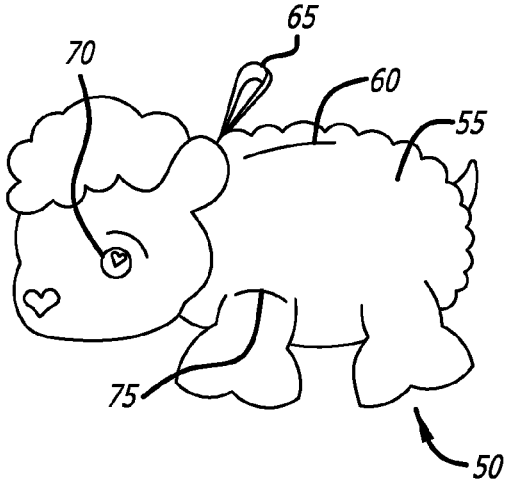
FIG. 8 is a side view of an embodiment of the present invention, which comprises a sheep-shaped, body-fed synthetic bath mitt.

In another embodiment illustrated by FIGS. 8-13, a bar of soap or liquid soap can be inserted through an opening in the body of the character-shaped mitt. FIG. 8 depicts a mitt 50 having a sheep shaped exterior 55. In this embodiment, an opening 60 is formed in a top surface of the mitt that allows access to the interior of the mitt. The mitt may also include, similar to the embodiment of FIG. 1, a decorative feature such as an eye 70 with, for example, a heart shape embossed or printed thereon, finger pocket 75, and tag 65.

Figure 9:
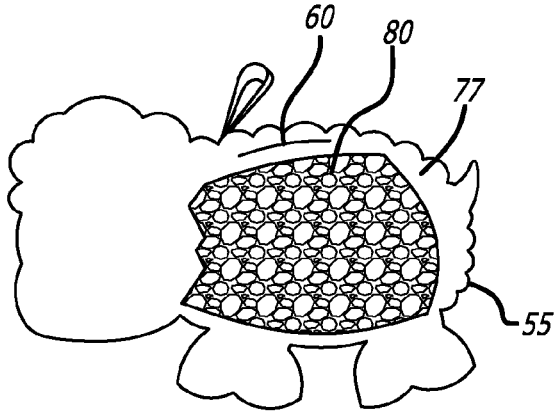
FIG. 9 is a side view, partially cut-away, of the embodiment of FIG. 8, illustrating a synthetic sponge material lining an interior cavity of the bath mitt of FIG. 8.
Figure 10:
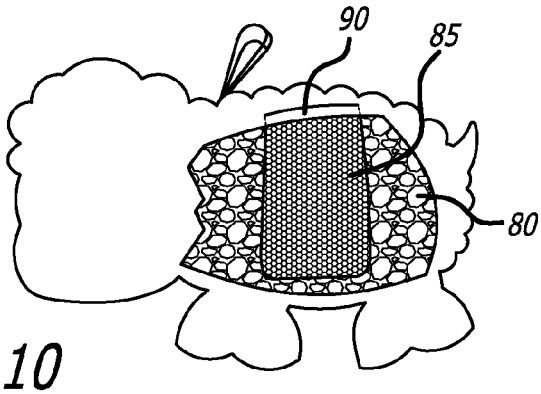
FIG. 10 is a side view, partially cut-away, of the embodiment of FIG. 8, illustrating a soap pocket formed within the synthetic sponge material lining the interior cavity of the bath mitt of FIG. 8.

FIG. 9 is a cross sectional side view of the embodiment of FIG. 8, showing an interior 77 that may be lined with sponge 80. FIG. 10 illustrates the positioning of a soap pocket 85 disposed within the sponge lining 80 in the interior of the mitt. The top of the soap pocket has an opening that allows access to an interior cavity of the soap pocket defined by the walls of the soap pocket. The opening is affixed to the walls of fabric defining the opening 60 in the top surface of the mitt. In some embodiments, a hook and loop fastener or other fastening means may be disposed at the opening 60 and configured to hold the opening 60 in a closed position when the sides of the opening are placed adjacent to each other.

Figure 11:
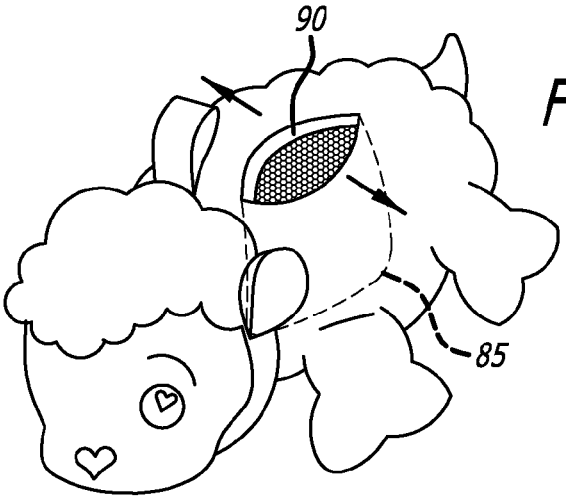
FIG. 11 is a perspective view of the embodiment of FIG. 8, illustrating the opening of a soap pocket in the body of the bath mitt.
Figure 12:
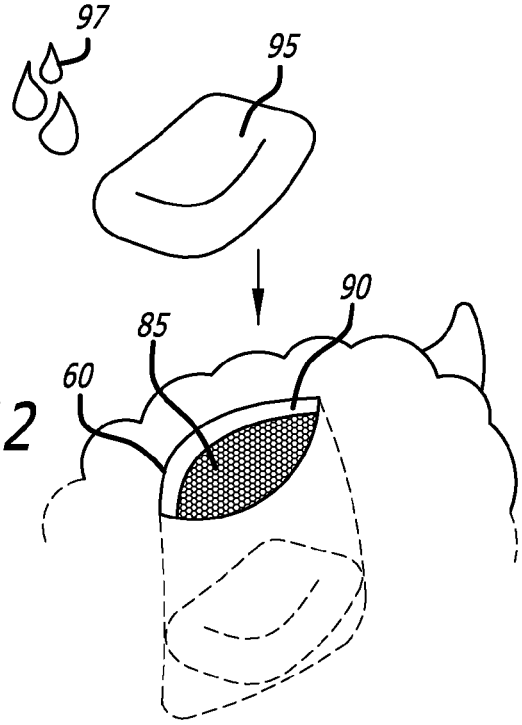
FIG. 12 is a partial perspective view of the embodiment of FIG. 11, illustrating the ability to insert a bar of soap or liquid soap into the soap pocket through the body of the bath mitt and place the bar of soap inside the soap pocket of the bath mitt.
Figure 13:
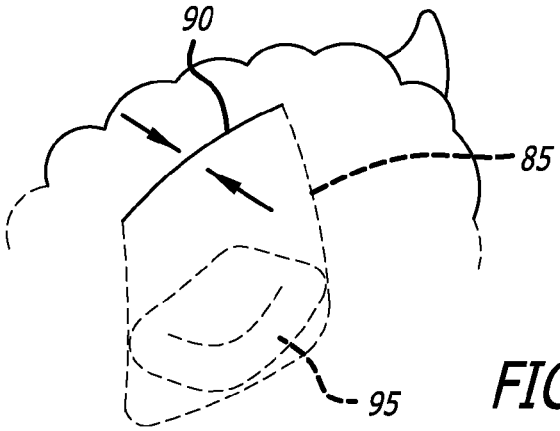
FIG. 13 is a partial perspective view of the embodiment of FIG. 11, illustrating the ability to fasten the soap pocket in the body of the bath mitt and to secure a bar of soap therein.

FIGS. 11-13 provide more detailed illustration of the insertion of soap into the interior of the mitt body, and one method of maintaining the soap therein during use. As shown in FIG. 11, the opening 60 is opened by pulling the hook and loop fastener apart, as indicated by the arrows. A bar of soap 95, or liquid soap 97, is disposed within soap pocket 85 by inserting it through opening 60. As shown in FIG. 10, opening 60 is closed by placing the sides of opening 60 next to one another, as indicated by the arrows, thus engaging the hook and loop fastener 90 to hold the opening in a closed position to retain the soap within the soap pocket 85.

Inserting the bar or liquid soap into the body of the character through an opening as shown in FIGS. 11-13 may one to insert and remove the bar of soap with more ease. Moreover, depending upon the position of the soap in relation to the sponge-like interior, may produce a more rich lather.

Figure 14:
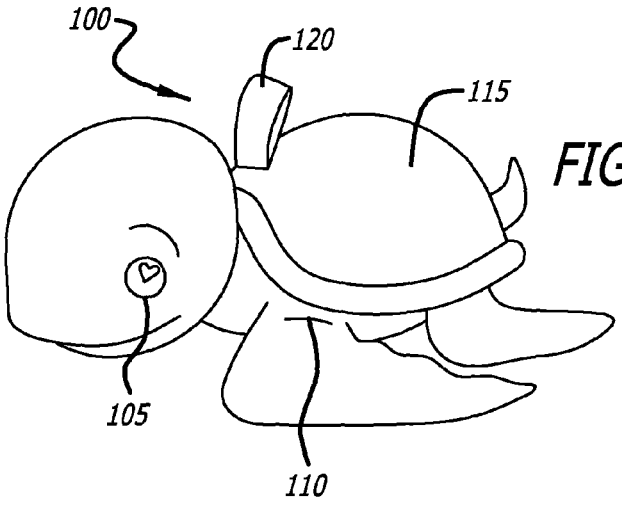
FIG. 14 is a side view of an embodiment of the present invention, which comprises a turtle-shaped, rear-fed bath mitt.

In yet another embodiment, as illustrated with reference to FIGS. 14-17, the bar of soap or liquid soap can be inserted through the rear or tail portion of the character-shaped mitt. For example, FIG. 14 depicts a mitt 100 having a turtle shaped exterior 115. In this embodiment, an opening (not shown in FIG. 14) is formed in a rear or tail portion of the mitt character that allows access to the interior of the mitt. The mitt may also include, similar to the embodiment of FIG. 1, a decorative feature such as an eye 105 with, for example, a heart shape embossed or printed thereon, finger pocket 110, and tag 120.

Figure 15:
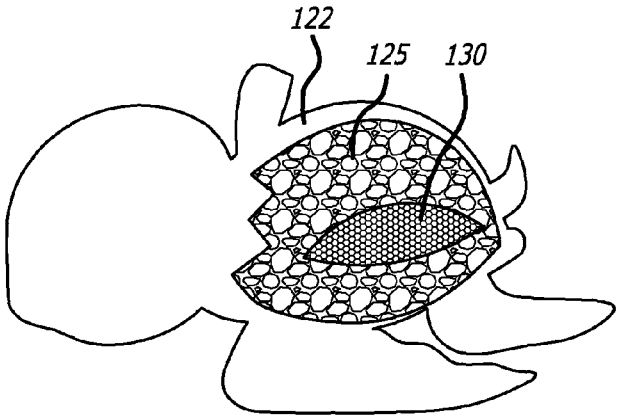
FIG. 15 is a side view, partially cut-away, of the embodiment of FIG. 14, illustrating a soap pocket formed within the synthetic sponge material lining the interior cavity of the bath mitt of FIG. 14.

FIG. 15 is a cross-sectional side view of the embodiment of FIG. 14. At least a portion of interior 122 of mitt 100 is lined with sponge 125. A soap pocket 130 is disposed within the sponge lining 125 within the interior 122 of mitt.

Figure 16:
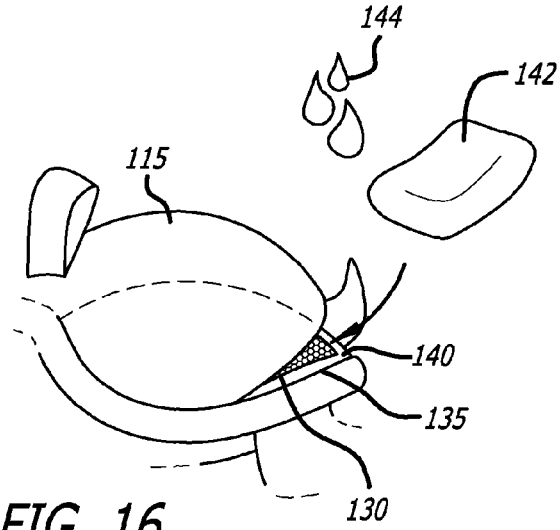
FIG. 16 is a partial side view, partially cut-away, of the embodiment of FIG. 14, illustrating the ability to lift the rear of the bath mitt, place bar soap or liquid soap inside the soap pocket of the sponge-lined interior cavity of the bath mitt and fasten the soap pocket.
Figure 17:
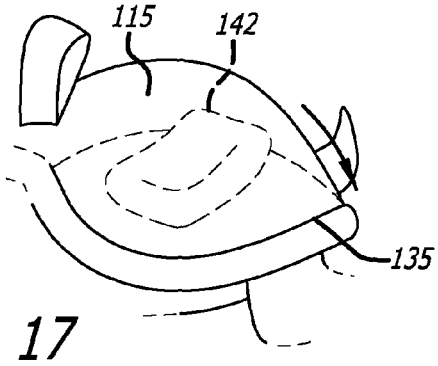
FIG. 17 is a partial side view of the embodiment of FIG. 16, illustrating a bar of soap which has been secured inside the pocket of the sponge-lined interior cavity of the bath mitt by closing the rear of the bath mitt.

FIG. 16 is partial view of the rear or tail portion of the character mitt 150 showing an opening 140 disposed in the rear or tail area of the mitt through which a bar of soap 142 or liquid soap 144 may be inserted into soap pocket 130. As with the embodiment shown in FIGS. 11-13, the edges of the opening may include a hook and loop type fastener 135. When the hook and loop type fastener 135 is engaged when opening 140 is closed, as shown in FIG. 17, the soap 142 is retained in the soap pocket disposed in the interior of the mitt.

In still another embodiment, the soap pocket of the character-shaped mitt can be made of nylon mesh, or other water-permeable material, and fastened using a child-safe, hook-and-loop or similar fastener to securely house a bar of soap. Forming the pocket from nylon mesh or other water-permeable material allows the water from the sponge-like interior of the cavity of the character-shaped mitt to interact closely with the bar of soap or liquid soap, allowing for production of rich lather. Further, the bar of soap is held in place while the mitt is in use by the hook-and-loop or similar fastener that keeps the pocket closed during use, but still allows for the rich lather to be released onto the user's skin.

In another embodiment, the sponge-like material may also include modifications to the structure of the material so as to enhance the formation of lather during use of the bath mitt. For example, weep holes may be included to enhance the formation of lather when the mitt is used. In still other embodiments, the sponge-like material may be formed from a synthetic material, or may be formed from a material such as a frog luffa or plastic material having a mesh or mesh-like structure.

In some embodiments, the soap pocket may be formed in a manner so as to hold and retain liquid soap within the sponge-lined interior cavity of the character-shaped mitt. In these embodiments, the soap pocket may be formed into a shape such that the liquid soap remains inside the soap pocket until the soap mixes with the water as the water drains from the sponge-like interior of the cavity.

While the various embodiments of the present invention have been illustrated using character-like depictions, it will be understood that other exterior shapes may be used for the bath mitt without departing from the scope of the intended invention. For example, but not limited to, the shape of the bath mitt may be formed as a non-character or icon, such as a sport logo, an automobile, airplane, sport ball or other sport equipment, or the like.

While several particular forms of the invention have been illustrated and described, it will be apparent that various modifications can be made without departing from the spirit and scope of the invention.

I claim:

1. A character-shaped porous cleansing mitt, comprising:

an outer body having a character shape defined by a central portion representing a body, the central portion have a proximal portion and a distal portion, two appendages extending from the proximal portion of the central portion representing legs or fins, and two appendages extending from the distal portion of the central portion representing legs or fins;

a cavity disposed within an interior of the outer body;

an opening in a portion of the outer body providing access to the cavity; and a pair of finger receivers disposed on opposite sides of the outer body at a junction between each of the appendages extending from the proximal portion of the central portion and the central portion such that the finger receiver is accessed from a top side of the junction, each of the pair of finger receivers configured to receive an end of one of a user's fingers for gripping the outer body by a hand of the user.

2. The mitt of claim 1, further comprising a sponge-like material disposed within the cavity.

3. The mitt of claim 2, wherein the sponge-like material has a soap pocket formed therein.

4. The mitt of claim 3, wherein the soap pocket is lined with a water-permeable material, and the water-permeable material providing structural reinforcement to the sponge to maintain the soap within the pocket under use.

5. The mitt of claim 4, wherein the material lining the pocket is attached to the mitt using a child-safe fastener.

6. The mitt of claim 5, wherein the fastener is a hook-and-loop fastener.

7. The mitt of claim 4, wherein the water-permeable material is a nylon mesh.

8. The mitt of claim 1, wherein the outer body is formed from a porous material.

9. The mitt of claim 8, wherein the porous material is a terry cloth.

10. The mitt of claim 1, wherein the cavity is configured to hold soap.

11. The mitt of claim 10, wherein the cavity is configured for holding a solid bar of soap.

12. The mitt of claim 10, wherein the cavity is configured for holding a liquid soap.

13. The mitt of claim 1, wherein the opening is disposed within a mouth portion of the mitt.

14. The mitt of claim 1, wherein the opening is disposed within a body portion of the mitt.

15. The mitt of claim 1, wherein the opening is disposed within a rear portion of the mitt.

16. The mitt of claim 1, wherein the finger receivers are pockets.

17. The mitt of claim 1, wherein the finger receivers are loops.

18. The mitt of claim 1, wherein the outer body has a rough-textured portion for providing added friction between the outer body and skin of a user.

* * * * *

UNITED STATES PATENT AND TRADEMARK OFFICE

CERTIFICATE OF CORRECTION

PATENT NO. : 9,044,121 B2
APPLICATION NO. : 14/013776
DATED : June 2, 2015
INVENTOR(S) : E. Ray Phillips It is certified that error appears in the above-identified patent and that said Letters Patent is hereby corrected as shown below:

In The Specification

Column 4, line 46, between “portion” and “a” replace “represent” with --representing--.
Column 5, line 42, replace “character shape” with --character-shaped--.
Column 5, line 43, replace “character shape” with --character-shaped--.
Column 5, line 58, replace “sheep shape” with --sheep-shaped--.
Column 6, line 22, between “may” and “one”, insert --allow--.
Column 6, line 29, replace “turtle shape” with --turtle-shaped--.
Column 6, line 42, replace “character shape” with --character-shaped--.
Column 7, line 7, replace “have” with --having--.

Signed and Sealed this
Eighth Day of December, 2015

Michelle K. Lee

Michelle K. Lee
*Director of the United States Patent and Trademark Office*